US005826147A

United States Patent [19]

Liu et al.

[11] Patent Number: 5,826,147

[45] Date of Patent: Oct. 20, 1998

[54] ELECTROSTATIC LATENT IMAGE DEVELOPMENT

[75] Inventors: Chu-heng Liu; Weizhong Zhao, both of Webster, N.Y.

[73] Assignee: Xerox Corporation, Stamford, Conn.

[21] Appl. No.: 883,292

[22] Filed: Jun. 27, 1997

[51] Int. Cl.[6] ..... G03G 15/10; G03G 15/16

[52] U.S. Cl. ..... 399/237; 399/296

[58] Field of Search ..... 399/237–240, 399/296

[56] References Cited

U.S. PATENT DOCUMENTS

| | | | |
|---|---|---|---|
| 4,504,138 | 3/1985 | Kuehnle et al. | 399/240 |
| 5,260,752 | 11/1993 | Fuma et al. | 399/296 X |
| 5,351,113 | 9/1994 | Pietrowski et al. | 399/296 |
| 5,387,760 | 2/1995 | Miyazawa et al. | 399/239 |
| 5,436,706 | 7/1995 | Landa et al. | 399/238 |
| 5,619,313 | 4/1997 | Domoto et al. | 399/233 |

FOREIGN PATENT DOCUMENTS 3-111719 5/1991 Japan .

*Primary Examiner*—William J. Royer
*Attorney, Agent, or Firm*—Denis A. Robitaille

[57] ABSTRACT

A novel image development method and apparatus, wherein an imaging member having an imaging surface is provided with a layer of marking material thereon, and an electrostatic latent image is created in the layer of marking material. Image-wise charging of the layer of marking material is accomplished by a wide beam ion source such that free mobile ions are introduced in the vicinity of an electrostatic latent image associated with the imaging member having the layer of marking material coated thereon. The latent image associated with the imaging member causes the free mobile ions to flow in an image-wise ion stream corresponding to the latent image, which, in turn, leads to image-wise charging of the toner layer, such that the toner layer itself becomes the latent image carrier. The latent image carrying toner layer is subsequently developed and transferred to a copy substrate to produce an output document.

94 Claims, 4 Drawing Sheets

ELECTROSTATIC LATENT IMAGE DEVELOPMENT

This invention relates generally to electrostatic latent image development, and, more particularly, concerns an apparatus and method for developing an electrostatic latent image having a layer of developing or toner material coated thereon by selectively applying a charge potential to the layer to create an image-wise charged toner layer capable of being developed and selectively separated and transferred, thereby producing an output image corresponding thereto.

Generally, processes for electrostatographic copying and printing are initiated by selectively charging and/or discharging a charge receptive imaging member in accordance with an original input document or an imaging signal, generating an electrostatic latent image on the imaging member. This latent image is subsequently developed into a visible image by a process in which charged developing material is deposited onto the surface of the latent image bearing member, wherein charged particles in the developing material adhere to image areas of the latent image. The developing material typically comprises carrier granules having marking or toner particles adhering triboelectrically thereto, wherein the toner particles are electrostatically attracted from the carrier granules to the latent image areas to create a powder toner image on the imaging member. Alternatively, the developing material may comprise a liquid developing material comprising a carrier liquid having pigmented marking particles (or so-called toner solids) and charge director materials dispersed and/or dissolved therein (so-called liquid toner), wherein the liquid developing material is applied to the latent image bearing imaging member with the marking particles being attracted to the image areas of the latent image to form a developed liquid image. Regardless of the type of developing material employed, the toner or marking particles of the developing material are uniformly charged and electrostatically attracted to the latent image to form a visible developed image corresponding to the latent image on the imaging member. The developed image is subsequently transferred, either directly or indirectly, from the imaging member to a copy substrate, such as paper or the like, to produce a "hard copy" output document. In a final step, the imaging member is cleaned to remove any charge and/or residual developing material therefrom in preparation for a subsequent image forming cycle.

The above-described electrostatographic printing process is well known and has been implemented in various forms in the marketplace to facilitate, for example, so-called light lens copying of an original document, as well as for printing of electronically generated or digitally stored images where the electrostatic latent image is formed via a modulated laser beam. Analogous processes also exist in other electrostatic printing applications such as, for example, ionographic printing and reproduction where charge is deposited in image-wise configuration on a dielectric charge retentive surface (see, for example, U.S. Pat. No. 4,267,556 and 4,885,220, among numerous other patents and publications), as well as other electrostatic printing systems wherein a charge carrying medium is adapted to carry an electrostatic latent image. It will be understood that the instant invention applies to all various types of electrostatic printing systems and is not intended to be limited by the manner in which the image is formed on the imaging member or the nature of the latent image bearing member itself.

As described hereinabove, the typical electrostatographic printing process includes a development step whereby developing material including marking or toner particles is physically transported into contact with the imaging member so as to selectively adhere to the latent image areas thereon in an image-wise configuration. Development of the latent image is usually accomplished by electrical attraction of toner or marking particles to the image areas of the latent image. The development process is most effectively accomplished when the particles carry electrical charges opposite in polarity to the latent image charges, with the amount of toner or marking particles attracted to the latent image being proportional to the electrical field associated with the image areas. Some electrostatic imaging systems operate in a manner wherein the latent image includes charged image areas for attracting developer material (so-called charged area development (CAD), or "write white" systems), while other printing processes operate in a manner such that discharged areas attract developing material (so-called discharged area development (DAD), or "write black" systems).

Image quality in electrostatographic printing applications may vary significantly due to numerous conditions affecting latent image formation as well as development, among various other factors. In particular, image development can be effected by charge levels, both in the latent image, as well as in the developing material. For example, when the charge on dry toner particles becomes significantly depleted, binding forces with the carrier also become depleted, causing an undesirable increase in image development, which, in turn, causes the development of the latent image to spread beyond the area defined thereby. Similarly, one problem affecting the control of image quality in ionographic devices involves a phenomenon known as "image blooming" resulting from the effect of previously deposited ions or charge on the path of subsequent ions directed to the charge retentive surface. This problem is particularly noticeable when printing characters and edges of solid areas, resulting in character defects, wherein blooming artifacts may include picture elements being displaced by 1–2 pixels in distance. Image blooming can also be caused by poor charge retention and/or charge migration in the electrostatic latent image on the latent image bearing member, a problem which is particularly prevalent in ionographic systems, wherein a focused beam ion source is utilized for image-wise charging of a dielectric latent image bearing member.

The present invention specifically contemplates a novel electrostatographic imaging process wherein an electrostatic latent image bearing member having a layer of marking material or toner particles coated thereon is selectively charged in an imagewise manner to create a secondary latent image corresponding to the electrostatic latent image on the imaging member. Image-wise charging is accomplished by a wide beam charge source for introducing free mobile charges or ions in the vicinity of the electrostatic latent image coated with the layer of marking material or toner particles. The latent image causes the free mobile charges or ions to flow in an image-wise ion stream corresponding to the latent image. These charges or ions, in turn, are captured by the marking material or toner particles, leading to image-wise charging of the marking material or toner particles with the layer of marking material or toner particles itself becoming the latent image carrier. The latent image carrying toner layer is subsequently developed by selectively separating and transferring image areas of the toner layer to a copy substrate for producing an output document.

More generally, the present invention contemplates an imaging apparatus, wherein an electrostatic latent image including image and non-image areas is formed in a layer of marking material, and further wherein the latent image can be developed by selectively separating portions of the latent image bearing layer of marking material such that the image areas reside on a first surface and the non-image areas reside on a second surface. In a simple embodiment, the invention can be defined as an image development apparatus, comprising a system for generating a first electrostatic latent image on an imaging member, wherein the electrostatic latent image includes image and non-image areas having distinguishable charge potentials, and a system for generating a second electrostatic latent on a layer of marking materials situated adjacent the first electrostatic latent image on the imaging member, wherein the second electrostatic latent image includes image and non-image areas having distinguishable charge potentials of a polarity opposite to the charge potentials of the charged image and non-image areas in the first electrostatic latent image.

The following disclosures may be relevant to some aspects of the present invention:

U.S. Pat. No. 4,504,138

Patentee: Kuehnle et al.

Issued: Mar. 12, 1985

U.S. Pat. No. 5,387,760

Patentee: Miyazawa et al

Issued: Feb. 7, 1995

U.S. Pat. No. 5,436,706

Patentee: Landa et al.

Issued: Jul. 25, 1995

U.S. Pat. No. 5,619,313

Patentee: Domoto et al.

Issued: Apr. 8, 1997

The relevant portions of the foregoing patents may be briefly summarized as follows:

U.S. Pat. No. 4,504,138 discloses a method of developing a latent electrostatic charge image formed on a photoconductor surface comprising the steps of applying a thin viscous layer of electrically charged toner particles to an applicator roller preferably by electrically assisted separation thereof from a liquid toner suspension, defining a restricted passage between the applicator roller and the photoconductor surface which approximates the thickness of the viscous layer, and transferring the toner particles from the applicator roller at the photoconductor surface due to the preferential adherence thereof to the photoconductor surface under the dominant influence of the electric field strength of the electrostatic latent image carried by the photoconductive surface, the quantity of toner particles transferred being proportional to the relative incremental field strength of the latent electrostatic image. An apparatus for carrying out the method of the invention is also disclosed, which includes an applicator roller mounted for rotation in a container for toner suspension, an electrode arranged adjacent the circumferential surface of the roller to define an electrodeposition chamber therebetween and electrical connections between the roller, the electrode and a voltage source to enable electrolytic separation of toner particles in the chamber, forming a thin highly viscous layer of concentrated toner particles on the roller.

U.S. Pat. No. 5,387,760 discloses a wet development apparatus for use in a recording machine to develop a toner image corresponding to an electrostatic latent image on an electrostatic latent image carrier. The apparatus includes a development roller disposed in contact with or near the electrostatic latent image carrier and an application head for applying a uniform layer of the wet developer to the roller.

U.S. Pat. No. 5,436,706 discloses an imaging apparatus including a first member having a first surface having formed thereon a latent electrostatic image, wherein the latent electrostatic image includes image regions at a first voltage and background regions at a second voltage. A second member charged to a third voltage intermediate the first and second voltages is also provided, having a second surface adapted for resilient engagement with the first surface. A third member is provided, adapted for resilient contact with the second surface in a transfer region. The imaging apparatus also includes an apparatus for supplying liquid toner to the transfer region thereby forming on the second surface a thin layer of liquid toner containing a relatively high concentration of charged toner particles, as well as an apparatus for developing the latent image by selective transferring portions of the layer of liquid toner from the second surface to the first surface.

U.S. Pat. No. 5,619,313 discloses a method and apparatus for simultaneously developing and transferring a liquid toner image. The method includes the steps of moving a photoreceptor including a charge bearing surface having a first electrical potential, applying a uniform layer of charge having a second electrical potential onto the charge bearing surface, and image-wise dissipating charge from selected portions on the charge bearing surface to form a latent image electrostatically, such that the charge-dissipated portions of the charge bearing surface have the first electrical potential of the charge bearing surface. The method also includes the steps of moving an intermediate transfer member biased to a third electrical potential that lies between said first and said second potentials, into a nip forming relationship with the moving imaging member to form a process nip. The method further includes the step of introducing charged liquid toner having a fourth electrical potential into the process nip, such that the liquid toner sandwiched within the nip simultaneously develops image portions of the latent image onto the intermediate transfer member, and background portions of the latent image onto the charge bearing surface of the photoreceptor.

In accordance with one aspect of the present invention, there is provided an image development apparatus, comprising means for image-wise charging of a toner layer by a wide beam charging source capable of introducing free mobile charges or ions in the vicinity of an electrostatic latent image coated with a layer of developing material, whereby the latent image causes the free mobile charges or ions to flow in an image-wise charge or ion stream corresponding to the latent image. Means are also provided for developing the latent image carrying toner layer and transferring the developed toner layer to a copy substrate for producing an output document.

In accordance with another aspect of the present invention, an imaging apparatus, comprising an imaging member for having an electrostatic latent image formed thereon is provided. The imaging member includes a surface capable of supporting a layer of marking material which may be in the form of toner particles. An imaging device is also provided for generating the electrostatic latent image on the imaging member, wherein the electrostatic latent image includes image areas defined by a first charge voltage and non-image areas defined by a second charge voltage distinguishable from the first charge voltage. A marking material supply apparatus is also provided for depositing marking material on the surface of the imaging member to form a layer of marking material thereon adjacent the electrostatic latent image on the imaging member. In addition, a charge source is provided for selectively delivering charges to the layer in an image-wise manner responsive to the electrostatic latent image on the imaging member to form a secondary latent image in the marking material layer having image and non-image areas corresponding to the electrostatic latent image on said imaging member. A separator member is also provided for selectively separating portions of the layer of marking material in accordance with the secondary latent image in the layer of marking material to create a developed image corresponding to the electrostatic latent image formed on said imaging member.

In accordance with another aspect of the present invention, an imaging process is provided, comprising the steps of: generating an electrostatic latent image on an imaging member having a surface capable of supporting a masking material, wherein the electrostatic latent image includes image areas defined by a first charge voltage and non-image areas defined by a second charge voltage distinguishable from the first charge voltage; depositing marking material on the surface of the imaging member to form a layer of marking material thereon adjacent the image and non-image areas of the electrostatic latent image; selectively delivering charges or ions to the layer of marking material in an image-wise manner responsive to the electrostatic latent image on the imaging member for forming a secondary latent image in the layer of marking material, having image and non-image areas corresponding to the electrostatic latent image on the imaging member; and selectively separating and transferring portions of the layer of marking material from the imaging member in accordance with the secondary latent image therein for creating a developed image corresponding to the electrostatic latent image formed on the imaging member.

In accordance with another aspect of the present invention, an imaging apparatus is provided, comprising means for creating an electrostatic latent image including image and non-image areas in a toner layer, and means for developing or selectively separating the latent image bearing toner layer such that the image areas reside on a first surface and the non-image areas reside on a second surface.

In accordance with another aspect of the present invention, an imaging process is provided, comprising the steps of creating an electrostatic latent image including image and non-image areas in a toner layer on an electrostatic latent image bearing member, and selectively separating the latent image in the toner layer such that the image areas reside on a first surface and the non-image areas reside on a second surface.

In accordance with another aspect of the present invention, there is provided an image development apparatus, comprising means for generating a first electrostatic latent image on an imaging member, wherein the electrostatic latent image includes image and non-image areas having distinguishable charge potentials, and means for generating a second electrostatic latent image on a toner layer situated adjacent the first electrostatic latent image on the imaging member, wherein the second electrostatic latent image includes image and non-image areas having distinguishable charge potentials of a polarity opposite to the charge potentials of the charged image and non-image areas in the first electrostatic latent image.

In accordance with another aspect of the present invention, there is provided a process for image development, comprising the steps of generating a first electrostatic latent image on an imaging member, wherein the electrostatic latent image includes image and non-image areas having distinguishable charge potentials; and generating a second electrostatic latent on a toner layer situated adjacent the first electrostatic latent image on the imaging member, wherein the second electrostatic latent image includes image and non-image areas having distinguishable charge potentials of a polarity opposite to the charge potentials of the charged image and non-image areas in the first electrostatic latent image.

In accordance with another aspect of the present invention, there is provided an image development apparatus, comprising means for image-wise charging of a toner layer by introducing free mobile ions in the vicinity of an electrostatic latent image coated with a layer of developing material, whereby the latent image causes the free mobile ions to flow to the toner layer in an image-wise ion stream corresponding to the latent image, thereby creating a secondary latent image in the toner layer. Means are also provided for developing the secondary latent image by selectively separating portions thereof from the imaging member and further transferring the developed image to a copy substrate for producing an output document.

In accordance with the broadest aspects of the invention, an image development apparatus is described, comprising an imaging member including an imaging surface having a layer of marking material thereon, and means for creating an electrostatic latent image in the layer of marking material. In addition, an image development process for developing an image on an imaging member is described, comprising the steps of providing a layer of marking material on a surface of the imaging member, and generating an electrostatic latent image in the layer of marking material.

These and other aspects of the present invention will become apparent from the following description in conjunction with the accompanying drawings in which.

Figure 3:
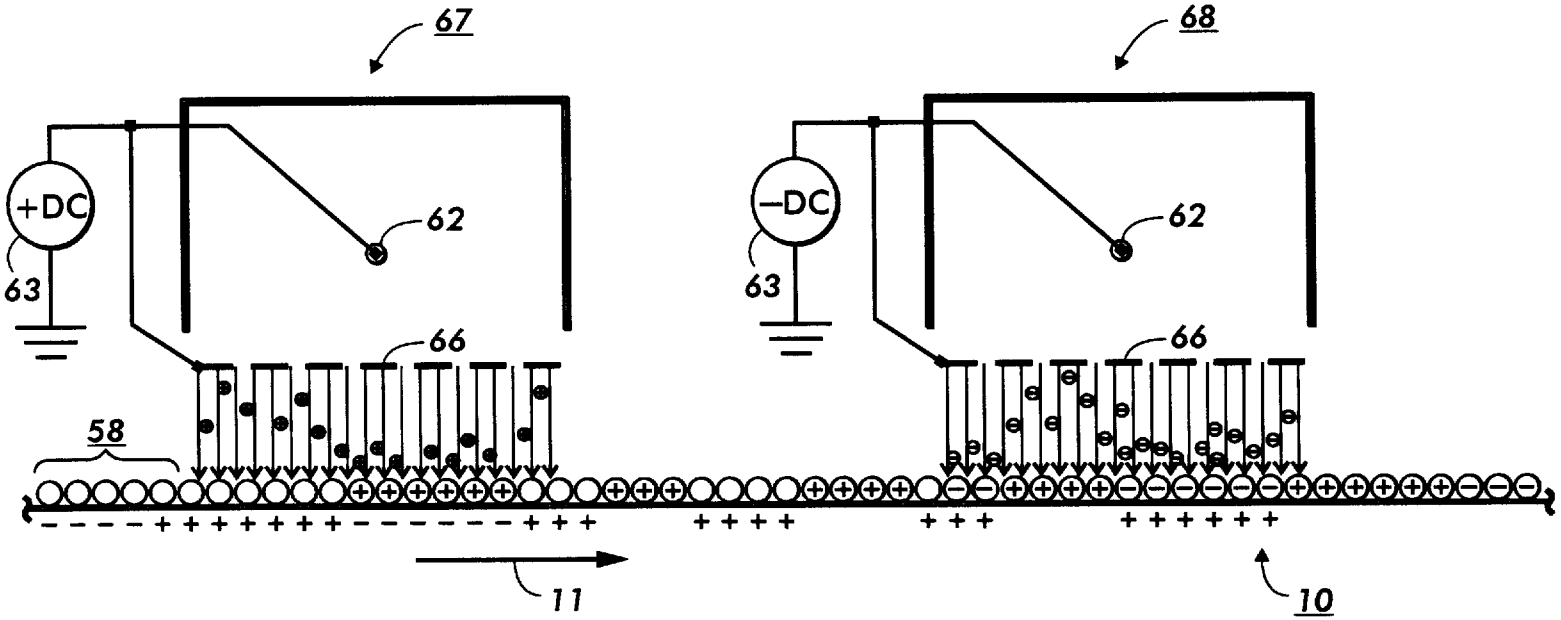
Figure 4:
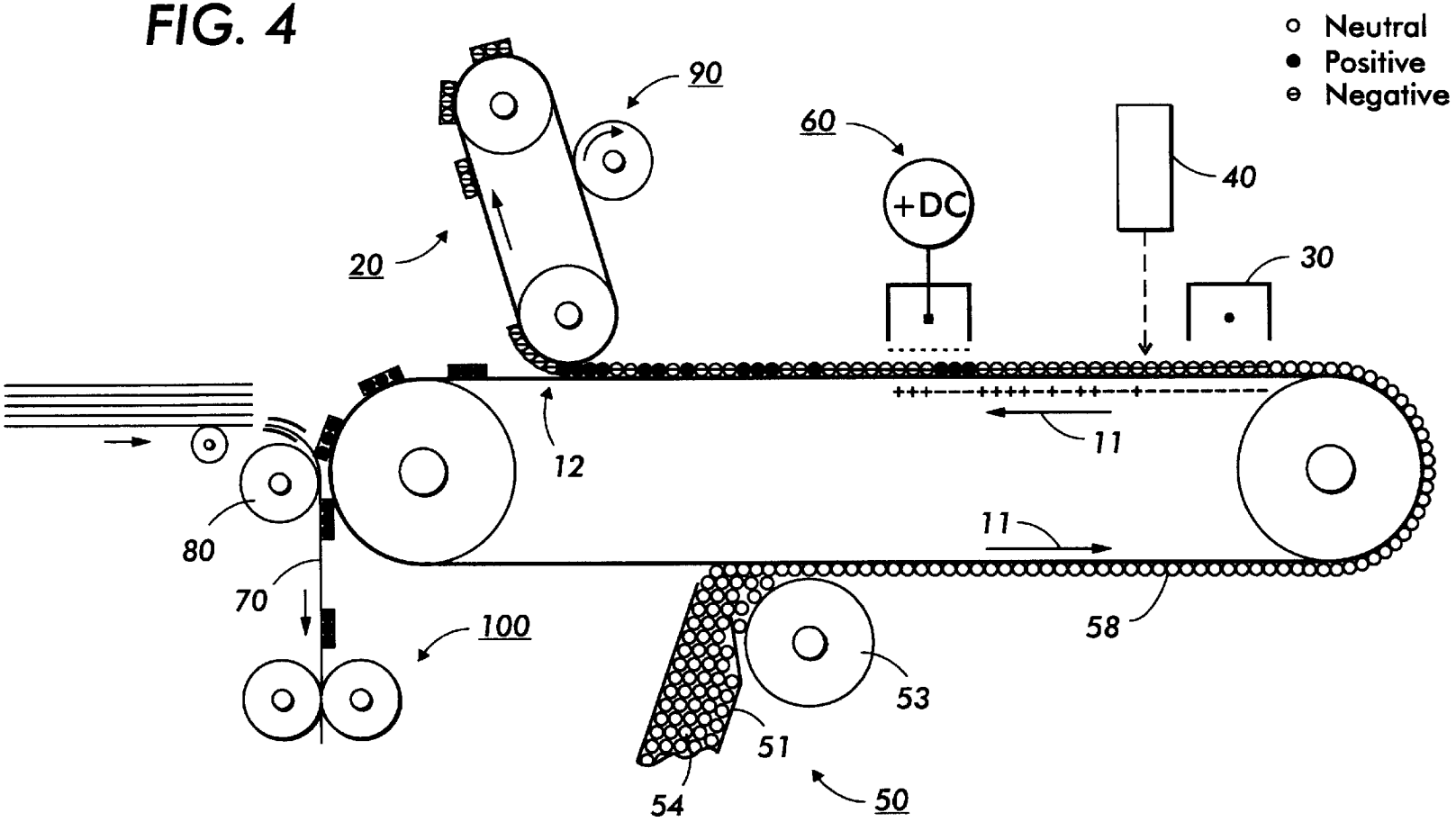

FIG. 3 is an exploded view illustrating image-wise toner layer charging of a neutrally charged toner layer, as contemplated by a second embodiment of the present invention; and FIG. 4 is a schematic elevational view of an alternative embodiment for a system incorporating a belt-type imaging member and other variant subsystems to provide image-wise toner layer charging and selective separation of the image-wise charged toner layer to produce an output image in accordance with the present invention.

For a general understanding of the features of the present invention, reference is made to the drawings, wherein like reference numerals have been used throughout to identify identical or similar elements. Initially, a system and process for accomplishing image-wise toner layer charging and selective separation of the latent image bearing toner layer in accordance with the present invention will be described with reference to FIG. 1. While the present invention will be described in terms of an illustrative embodiment or embodiments, it will be understood that the invention is adaptable to a variety of copying and printing applications, such that the present invention is not necessarily limited to the particular embodiment or embodiments shown and described herein. On the contrary, the following description is intended to cover all alternatives, modifications, and equivalents, as may be included within the spirit and scope of the invention as defined by the appended claims.

Figure 1:
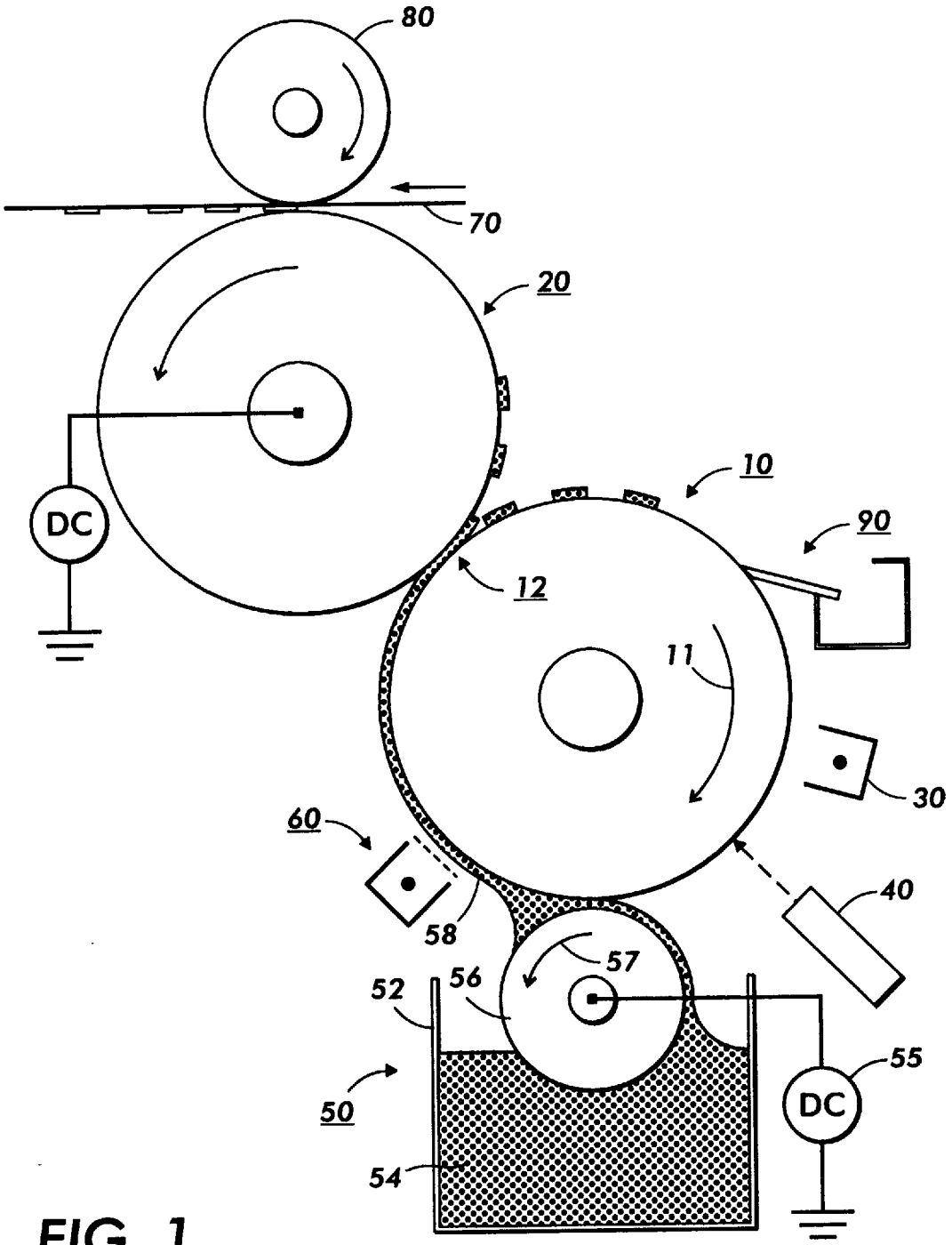
FIG. 1 is a simple schematic illustration depicting a system and process for image-wise toner layer charging and development in accordance with the present invention.

Moving now to FIG. 1, an exemplary imaging apparatus capable of image-wise toner charging in accordance with the present invention is shown, comprising an assemblage of operatively associated image forming elements, including an imaging member 10 situated in contact with an image separating member 20 at an image separating nip 12 formed therebetween. Imaging member 10 includes an imaging surface of any type capable of having an electrostatic latent image formed thereon. An exemplary imaging member 10 may include a typical photoconductor or other photoreceptive component of the type known to those of skill in the art in electrophotography, wherein a surface layer having photoconductive properties is supported on a conductive support substrate. Although the following description will describe by example a system and process in accordance with the present invention incorporating a photoconductive imaging member, it will be understood that the present invention contemplates the use of various alternative embodiments for an imaging member as are well known in the art of electrostatographic printing, including, for example, but not limited to, non-photosensitive imaging members such as a dielectric charge retaining member of the type used in ionographic printing machines, or electroded substructures capable of generating charged latent images.

Imaging member 10 is rotated, as indicated by arrow 11, so as to transport the surface thereof in a process direction for implementing a series of image forming steps in a manner similar to typical electrostatographic printing processes. Initially, in the exemplary embodiment of FIG. 1, the photoconductive surface of imaging member 10 passes through a charging station, which may include a corona generating device 30 or any other charging apparatus for applying an electrostatic charge to the surface of the imaging member 10. The corona generating device 30 is provided for charging the photoconductive surface of imaging member 10 to a relatively high, substantially uniform potential. It will be understood that various charging devices, such as charge rollers, charge brushes and the like, as well as induction and semiconductive charge devices among other devices which are well known in the art may be utilized at the charging station for applying a charge potential to the surface of the imaging member 10.

After the imaging member 10 is brought to a substantially uniform charge potential, the charged surface thereof is advanced to an image exposure station, identified generally by reference numeral 40. The image exposure station projects a light image corresponding to the input image onto the charged photoconductive surface. In the case of an imaging system having a photosensitive imaging member, as currently described, the light image projected onto the surface of the imaging member 10 selectively dissipates the charge thereon for recording an electrostatic latent image on the photoconductive surface. The electrostatic latent image comprises image areas defined by a first charge voltage and non-image areas defined by a second charge voltage, in image configuration corresponding to the input image informational areas. The image exposure station 40 may incorporate various optical image formation and projection components as are known in the art, and may include various well known light lens apparatus or digital scanning systems for forming and projecting an image from an original input document onto the imaging member 10. Alternatively, various other electronic devices available in the art may be utilized for generating electronic information to create the electrostatic latent image on the imaging member. It will be understood that the electrostatic latent image may be comprised of image and non-image areas that are defined areas having opposite charge polarities or by areas that merely have first and second distinguishable charge levels.

In a typical electrostatographic printing process, after the electrostatic latent image is generated on the surface of the imaging member, the image is developed into a visible image on the surface of the imaging member 10 by selectively attracting marking particles in the form of charged toner particles to areas of the latent image thereon. By contrast, in the present invention, a layer of charged or uncharged marking or toner particles is deposited on the entire surface of the latent image bearing imaging member 10. To that end, a toner supply apparatus or applicator 50 is provided, as depicted in the exemplary embodiment of FIG. 1, whereby a layer of charged or uncharged marking or toner particles (and possibly some carrier mechanism such as a liquid solvent) is transported onto the surface of the imaging member 10. The exemplary embodiment of FIG. 1 shows an illustrative toner applicator 50, wherein a housing 52 is adapted to accommodate a supply of toner particles 54 and any additional carrier material, if necessary. In an exemplary embodiment, the toner applicator 50 includes an applicator roller 56 which is rotated in a direction as indicated by arrow 57 to transport toner from housing 52 into contact with the surface of the imaging member 10, forming a substantially uniformly distributed layer of toner, or a so-called "toner cake", 58 thereon.

The toner cake described above can be created in various ways. For example, depending on the materials utilized in the printing process, as well as other process parameters such as process speed and the like, a layer of toner particles having sufficient thickness, preferably on the order of between 2 and 15 microns and more preferably between 3 and 8 microns, may be formed on the surface of the imaging member 10 by merely providing adequate proximity and/or contact pressure between the applicator roller 56 and the imaging member 10. Alternatively, electrical biasing may be employed to assist in actively moving the toner particles onto the surface of the imaging member 10. Thus, in one exemplary embodiment, the applicator roller 56 can be coupled to an electrical biasing source 55 for implementing a so-called forward biasing scheme, wherein the toner applicator 56 is provided with an electrical bias of magnitude greater than both the image and non-image (background) areas of the electrostatic latent image on the imaging member 10, thereby creating electrical fields extending from the toner applicator roll 56 to the surface of the imaging member 10. These electrical fields cause toner particles to be transported to imaging member 10 for forming a substantially uniform layer of toner particles on the surface thereof.

It will be understood that numerous other devices or apparatus may be utilized for applying toner layer 58 to the surface of the imaging member, including various well known apparatus analogous to development devices used in conventional electrostatographic applications, such as, but not limited to: powder cloud systems which transport developing material to the imaging member by means of a gaseous medium such as air; brush systems which transport developing material to the imaging member by means of a brush or similar member; and cascade systems which transport developing material to the imaging member by means of a system for pouring or cascading the toner particles onto the surface of the imaging member. In addition, various systems directed toward the transportation of liquid developing material having toner particles immersed in a carrier liquid, can be incorporated into the present invention. Examples of such a liquid transport system can include a fountain-type device as disclosed generally in commonly assigned U.S. Pat. No. 5,519,473 (incorporated by reference herein), or any other system capable of causing a flow of liquid developing material, including toner particles immersed in a liquid carrier medium, onto the surface of the imaging member. It is noted that, in the case of liquid developing materials, it is desirable that the toner cake formed on the surface of the imaging member 10 should be comprised of at least approximately 10% by weight toner solids, and preferably in the range of 15%–35% by weight toner solids.

With respect to the foregoing toner cake formation process and various apparatus therefor, it will be understood that the presence of the latent image on the imaging member may generate some fringe fields in areas of interface between image and non-image areas of the latent image. However, these fringe fields are minimal relative to the fields associated with conventional electrostatic latent image development such that, although some toner layer nonuniformity may result, the toner layer generated on the imaging member surface can be characterized as having a substantially uniform density per mass area in both image and background areas of the latent image. In fact, it is not a requirement of the invention that the toner layer be uniform or even substantially uniformly distributed on the surface of the imaging member 10, so long as the toner layer covers, at a minimum, the desired image areas of the latent image.

In accordance with the present invention, after the toner layer 58 is formed on the surface of the electrostatic latent image bearing imaging member 10, the toner layer is charged in an image-wise manner. In the case of a charged toner layer 58, as is the case in the system of FIG. 1, a charging device 60, represented schematically in FIG. 1 as a well known scorotron device, is provided for introducing free mobile ions in the vicinity of the charged latent image, to facilitate the formation of an image-wise ion stream extending from the source 60 to the latent image on the surface of the image bearing member 10, as will be described. The image-wise ion stream generates a secondary latent image in the toner layer made up of oppositely charged toner particles in image configuration corresponding to the latent image.

The process of generating a secondary latent image in the toner cake layer will be described in greater detail with respect to FIG. 2, where the initially charged toner cake 58 is illustrated, for purposes of simplicity only, as a uniformly distributed layer of negatively charged toner particles having the thickness of a single toner particle. The toner cake resides on the surface of the imaging member 10 which is being transported from left to right past the broad source ion charging device 60. As previously described, the primary function of the broad source ion charging device 60 is to provide free mobile ions in the vicinity of the imaging member 10 having the toner layer and latent image thereon. As such, the broad source ion device may be embodied as various known devices, including, but not limited to, any of the variously known corona generating devices available in the art, as well as charging roll type devices, solid state charge devices and electron or ion sources analogous to the type commonly associated with ionographic writing processes.

Figure 2:
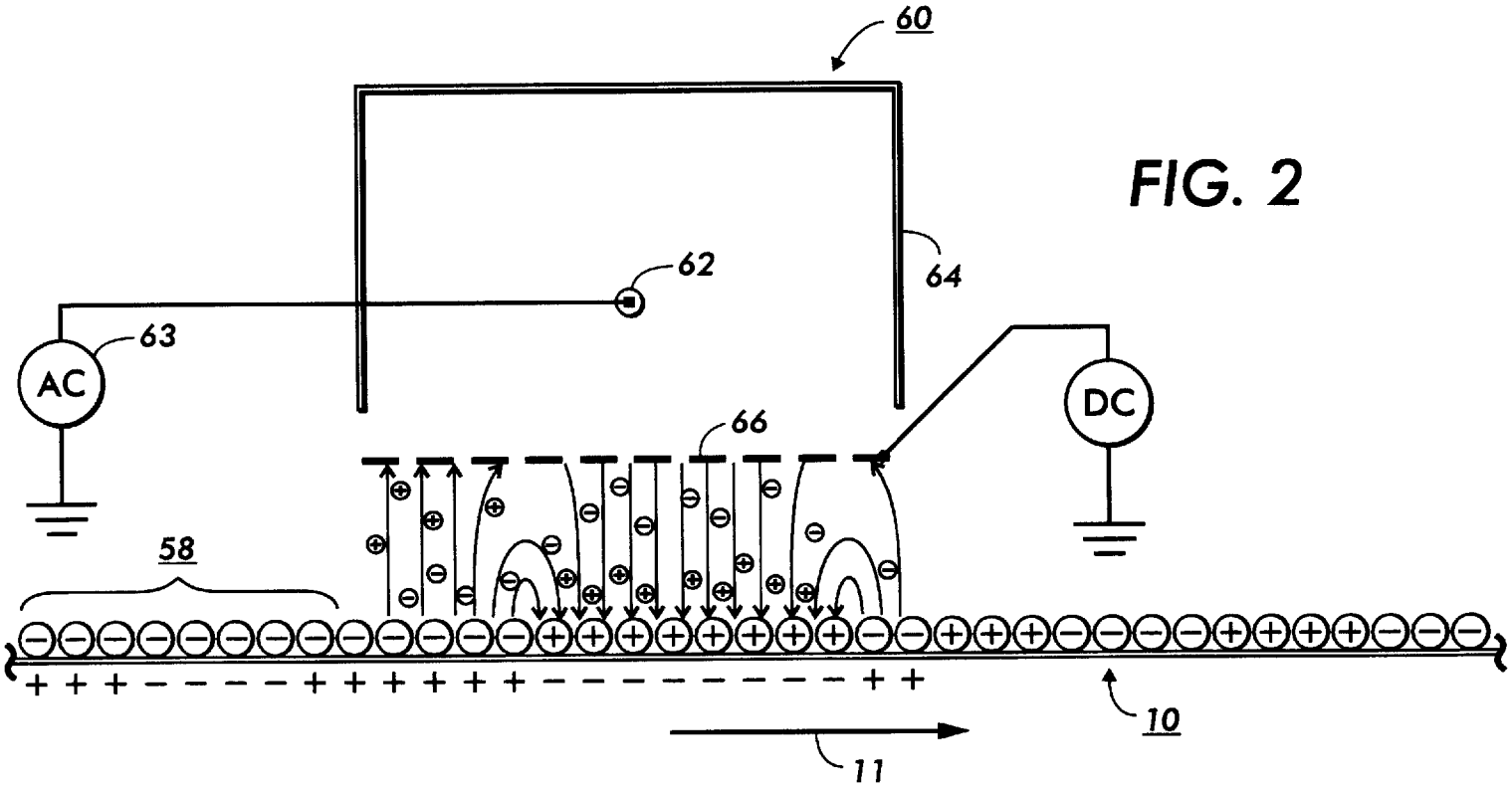
FIG. 2 is an exploded view illustrating image-wise charging of a toner layer by a broad source ion charging device, wherein a charged toner layer is selectively reverse charged in accordance with a latent image adjacent thereto, as contemplated by one embodiment of the present invention.

In the embodiment shown in FIG. 2, a scorotron type corona generating device is utilized. The scorotron device comprises a corona generating electrode 62 enclosed within a shield member 64 surrounding the electrode 62 on three sides. A wire grid 66 covers the open side of the shield member 64 facing the imaging member 10. In operation, the corona generating electrode 62, otherwise known as a coronode, is coupled to an electrical biasing source 63 capable of providing a relatively high voltage potential to the coronode, which causes electrostatic fields to develop between the coronode 62 and the grid and the imaging member 10. The force of these fields causes the air immediately surrounding the coronode to become ionized, generating free mobile ions which are repelled from the coronode toward the grid 66 and the imaging member 10. As is well known to one of skill in the art, the scorotron grid 66 is biased so as to be operative to control the amount of charge and the charge uniformity applied to the imaging surface 10 by controlling the flow of ions through the electrical field formed between the grid and the imaging surface.

With respect to the process illustrated by FIG. 2, it will be seen that the function of the charging device 60 is to charge the toner layer 58 in an image-wise manner. This process will be described with respect to a negatively charged toner layer, although it will be understood that the process can also be implemented using a positively charged toner layer. In addition, the process of the present invention can also be implemented using an uncharged or neutral toner layer, as will be described in greater detail as the present description proceeds. In the case of a charged toner layer, the process of the present invention requires that ion source 60 provide ions having a charge opposite the toner layer charge polarity. Thus, in the case of a negatively charged toner layer 58, as shown in FIG. 2, the scorotron 60 is preferably provided with an energizing bias at grid 66 intermediate the potential of the image and non-image areas of the latent image on the imaging member 10. Under certain circumstances, such as when the charge on the toner layer is sufficient to prevent charge reversal due to injected wrong sign charge, the energizing bias at the grid 66 can be higher or lower than the bias of the image and non-image areas of the latent image. In addition, the energizing bias applied to grid 66 can be provided in the form of either a direct current (DC) electrical bias or an alternating current (AC) bias having a DC offset. Operatively, in areas where the latent image is at a potential lower than the bias potential of the charging source grid 66, the bias potential generates electrostatic field lines in a direction toward the imaging member 10 and toner layer 58 thereon. Conversely, electrostatic field lines are generated in a direction away from the imaging member 10 and toner layer 58 thereon in areas where the latent image is at a potential higher than the bias potential of the charging source grid 66.

FIG. 2 illustrates the effect of the field lines in the case of an ion source energized by an AC voltage having a DC grid bias 66 voltage intermediate to the image and non image areas of the latent image, represented by (+) and (−) signs, respectively, on the back side of the imaging member 10. As illustrated, positive ions flow from the ion source 60 in the direction of the field lines while negative ions (electrons) flow in a direction opposite to the direction of the field lines such that the positive ions presented in the vicinity of a positively charged area of the latent image are repelled from the toner layer 58 while the positive ions in the vicinity of a negatively charged area of the latent image are attracted to the toner layer, and captured thereby. Conversely, negative ions presented in the vicinity of a positively charged area of the latent image are attracted to the imaging member 10 and absorbed into the negatively charged toner 58 thereby enhancing toner charge in that area, while the negative ions in the vicinity of a negatively charged areas of the latent image are repelled by the toner layer. The free flowing ions generated by the ion source 60 are captured by toner layer 58 in a manner corresponding to the latent image on the imaging member, causing image-wise charging of the toner layer 58, thereby creating a secondary latent image within the toner layer 58 that is charged opposite in charge polarity to the charge of the original latent image. Under optimum conditions, the charge associated with the original latent image will be captured and converted into the secondary latent image in the toner layer 58 such that the original electrostatic latent image is substantially or completely dissipated into the toner layer 58.

It will be noted that, in the above-described process, a charged toner layer is situated on a latent image bearing imaging member, wherein the charged toner layer is exposed to charged ions for selectively reversing the preexisting charge of the toner layer. Since the toner layer is initially charged, fringe fields, illustrated as field lines extending between image and non-image regions of the latent image can affect the uniformity of the charged toner cake. While the existence of these fringe fields may be advantageous if the fringe fields can be properly controlled, these fringe fields may manifest themselves as image quality defects in the final output document. The present invention contemplates an alternative embodiment to the image-wise toner layer charging process described hereinabove, wherein the fringe field effect may be eliminated. This process is illustrated diagramatically in FIG. 3, wherein the original toner layer 58 being transported past the ion source is depicted with no charge. Thus, in an alternative embodiment, the image-wise toner charging process of the present invention may be carried out using a neutrally charged toner cake layer coated on the imaging member. In this case an ion source, or multiple ion sources, must be provided for presenting both negative and positive polarity ions to the toner layer in the vicinity of the latent image for oppositely charging regions of the toner layer corresponding to image and non image areas of the latent image. In an exemplary embodiment, an AC driven scorotron device can be used to provide ions of opposite polarity. Alternatively, as illustrated in FIG. 3, a combination of two independent ion sources capable of providing opposite polarity ions can be used. Optionally, independent broad source ion generating devices as variously known in the art may be incorporated, either as a single AC driven device capable of providing both positive and negative charge ions, or as a pair of DC driven devices for providing the same.

In the exemplary embodiment of FIG. 3, the ion sources are provided in the form of first and second corona generating devices 67 and 68, each independently driven by DC biasing sources 63 to provide oppositely charged ion streams. This embodiment operates in a manner similar to the embodiment of FIG. 2, wherein positive ions generated by ion source 67 in the vicinity of a positively charged area of the latent image are repelled by the underlying latent image, while the positive ions in the vicinity of negatively charged areas of the latent image are attracted to the imaging member 10 and captured by the toner layer. Conversely, negative ions generated by ion source 68 are absorbed or captured by the neutral toner particles adjacent positively charged areas of the latent image, while negative ions in the vicinity of a negatively charged areas of the latent image are repelled by the latent image. Thus, the free flowing ions generated by ion sources 67 and 68 are selectively captured by toner layer 58 in accordance with the charge of the latent image areas on the imaging member. This process induces image-wise charging of the toner layer 58, creating a secondary latent image within toner layer 58 made up of image and background areas which are charged oppositely with respect to the charge of the original latent image on the imaging member 10. Once again, under optimum conditions, the charge of the original latent image may be converted into the secondary latent image in the toner layer such that the original electrostatic latent image is substantially or completely dissipated into the toner layer after the image-wise toner charging process is complete.

Once the secondary latent image is formed in the toner layer, the latent image bearing toner layer is advanced to the image separator 20. Referring back to FIG. 1, image separator 20 may be provided in the form of a biased roll member having a surface adjacent to the surface of the imaging member 10 and preferably contacting the toner layer 58 residing on image bearing imaging member 10. An electrical biasing source is coupled to the image separator 20 to bias the image separator 20 so as to attract either image or non-image areas of the latent image formed in the toner layer 58 for simultaneously separating and developing the toner layer 58 into image and non-image portions. In the embodiment of FIG. 1, the image separator 20 is biased with a polarity opposite the charge polarity of the image areas in the toner layer 58 for attracting image areas therefrom, thereby producing a developed image made up of selectively separated and transferred portions of the toner cake on the surface of the image separator 20, while leaving background image byproduct on the surface of the imaging member 10. Alternatively, the image separator 20 can be provided with an electrical bias having a polarity appropriate for attracting non-image areas away from the imaging member 10, thereby maintaining toner portions corresponding to image areas on the surface of the imaging member, yielding a developed image thereon, while removing non-image or background areas with the image separator 20.

After the developed image is created, either on the surface of the imaging member 10 or on the surface of the imaging separator 20, the developed image may then be transferred to a copy substrate 70 via any means known in the art, which may include an electrostatic transfer apparatus including a corona generating device of the type previously described or a biased transfer roll. Alternatively, a pressure transfer system may be employed which may include a heating and/or chemical application device for assisting in the pressure transfer and fixing of the developed image on the output copy substrate 70. In yet another alternative, image transfer can be accomplished via surface energy differentials wherein the surface energy between the image and the member supporting the image prior to transfer is lower than the surface energy between the image and the substrate 70, inducing transfer thereto. In a preferred embodiment, as shown in FIG. 1, the image is transferred to a copy substrate via a heated pressure roll 80, whereby pressure and heat are simultaneously applied to the image to simultaneously transfer and fuse the image to the copy substrate 70. It will be understood that separate transfer and fusing systems may be provided, wherein the fusing or so-called fixing system may operate using heat (by any means such as radiation, convection, conduction, induction, etc.), or other known fixation process which may include the introduction of a chemical fixing agent. Since the art of electrostatographic printing is well known, it is noted that several concepts for transfer and/or fusing which could be beneficially used in combination with the image-wise charging system of the present invention have been disclosed in the relevant patent literature.

In a final step in the process the background image byproduct on either the imaging member 10 or the image separator 20 is removed from the surface thereof in order to clean the surface in preparation for a subsequent imaging cycle. FIG. 1 illustrates a simple blade cleaning apparatus 90 for scraping the imaging member surface as is well known in the art. Alternative embodiments may include a brush or roller member for removing toner from the surface on which it resides. In a preferred embodiment the removed toner associated with the background image is transported to a toner sump or other reclaim vessel so that the waste toner can be recycled and used again to produce the toner cake in subsequent imaging cycles. Once again, it is noted that several concepts for cleaning and toner reclaim which could be beneficially used in combination with the image-wise charging system of the present invention have been disclosed in the relevant patent literature.

It will be understood that the apparatus and processes described hereinabove represent only a few of the numerous system variants that could be implemented in the practice of the present invention. One particular variant printing system incorporating the teaching of the present invention will be described with respect to FIG. 4, wherein imaging member 10 is provided in the form of a belt entrained about a pair of roll members including a drive roller driven by a conventional motor device (not shown) for advancing the belt in a process direction along a curvilinear path, thereby transporting the imaging member 10 through various processing stations disposed about the path of movement thereof.

In the embodiment of FIG. 4, a neutrally charged toner cake is deposited on an uncharged imaging member 10 via a toner supply apparatus 50 including a fountain-type applicator 51 in combination with a metering roll 53. Metering roll 53 includes a peripheral surface situated in close proximity to the surface of imaging member 10, preferably rotated in a direction opposite to the direction of movement of the imaging member 10, providing a shear force against the toner layer deposited on the surface of the imaging member, for controlling the thickness of the toner layer thereon. Thus, the metering roll 53 meters a predetermined amount of developing material 54 (which may include toner particles immersed in liquid carrier). The excess material eventually falls away from the metering roll and may be transported to a sump for reuse in the toner applicator 51.

The neutrally charged toner layer deposited on the imaging member 10 is subsequently advanced to a charging station, shown to include a corona charging device 30. In this embodiment, the corona charging device 30 applies a charge through the neutrally charged toner layer 58 to the surface of the imaging member 10 such that both the imaging member 10 and the toner layer 58 will become charged. Thus, the imaging member attracts ions through the toner layer in order to become charged. In this process, some ions will be captured by the toner layer 58, generating a similar, albeit weaker, polarity charge therein, as illustrated by the negatively charged toner particles in FIG. 4.

The charged imaging member 10 having a now similarly charged toner layer 58 thereon, is next advanced to image exposure station 40 which, in the case of a photoreceptive imaging member 10, selectively dissipates the charged areas of the imaging member 10 to create an electrostatic latent image thereon. It will be understood that image exposure apparatus 40 may be positioned so as to irradiate imaging member 10 through toner layer 58 (as shown), or may be positioned so as to irradiate imaging member 10 from the underside of the imaging member 10, such that image exposing light is not required to travel through the toner layer.

As a result of the foregoing process steps, a layer of charged toner particles is positioned on the surface of a latent image bearing imaging member 10. Proceeding now with the image-wise toner layer charging process contemplated by the present invention, the charged toner layer 58 is advanced past a broad beam ion source 60, represented in FIG. 4 as a scorotron. The scorotron introduces free mobile ions in the vicinity of the charged latent image, generating an image-wise ion stream in the presence of the latent image on the imaging member 10, as described in greater detail herein with respect to FIG. 2.

In the embodiment of FIG. 4, image separator 20 is also provided in the form of a belt member entrained about a pair of opposed rollers. The image separator 20 is preferably driven by contact engagement with the toner imaging member 10, although a drive device could also be coupled to one of the rollers for providing transport motion to the image separator belt. In this embodiment, electrical bias may be applied to the roll member adjacent the imaging member in a manner disclosed with respect to FIG. 1. Alternatively, electrical bias can be applied directly to the belt via a brush or well known commutator brush-type system. Such a commutator brush system may be desirable to permit voltage variations in the nip 12 formed between the imaging member 10 and the image separator 20, thereby enabling a field tailoring approach similar to that disclosed in the prior art, as for example in commonly assigned U.S. Pat. Nos. 5,198,864 and 5,428,429, hereby incorporated by reference into the present patent application.

The embodiment of FIG. 4 contemplates that the image separator 20 can be used to remove image background areas form the toner layer 58. Thus, the image separator 20 is biased so as to attract image background areas from the imaging member 10, thereby maintaining toner segments corresponding to image areas on the surface of the imaging member 10. Accordingly, the toner segments on image separator 20 are transported to a cleaning device 90, embodied as a roll member, while developed image areas remaining on the imaging member 10 are transported to a transfer station as typically found in a conventional electrostatographic printing machine. The toner segments making up the image are transferred to a copy substrate via any method which may be known in the art. The transferred image may thereafter be fused to the copy substrate at fusing station 100 and transported to an output device for retrieval by a machine operator.

In review, the present invention provides a novel image development method and apparatus, whereby image-wise charging is accomplished by a wide beam ion source such that free mobile ions are introduced in the vicinity of an electrostatic latent image coated with a layer of developing material. The latent image causes the free mobile ions to flow in an image-wise ion stream corresponding to the latent image, which, in turn, leads to image-wise charging of the toner layer, such that the toner layer itself becomes the latent image carrier. The latent image carrying toner layer is subsequently developed and transferred to a copy substrate to produce an output document.

It is, therefore, evident that there has been provided, in accordance with the present invention an image-wise toner layer charging system for image development and transfer that fully satisfies the aspects of the invention hereinbefore set forth. While this invention has been described in conjunction with a particular embodiment thereof, it shall be evident that many alternatives, modifications and variations will be apparent to those skilled in the art. Accordingly, the present invention is intended to embrace all such alternatives, modifications and variations as fall within the spirit and broad scope of the appended claims.

We claim:

1. An imaging apparatus, comprising:

an imaging member for having an electrostatic latent image formed thereon, said imaging member having a surface capable of supporting marking material;

an imaging device for generating the electrostatic latent image on said imaging member, wherein the electrostatic latent image includes image areas defined by a first charge voltage and non-image areas defined by a second charge voltage distinguishable from the first charge voltage;

a marking material supply apparatus for depositing marking material on the surface of said imaging member to form a marking material layer thereon adjacent the electrostatic latent image on said imaging member;

a charging source for selectively delivering charges to the marking material layer in an image-wise manner responsive to the electrostatic latent image on said imaging member to form a secondary latent image in the marking material layer having image and non-image areas corresponding to the electrostatic latent image on said imaging member; and a separator member for selectively separating portions of the marking material layer in accordance with the secondary latent image in the marking material layer to create a developed image corresponding to the electrostatic latent image formed on said imaging member.

2. The imaging apparatus of claim 1, wherein said imaging member includes a photosensitive imaging substrate.

3. The imaging apparatus of claim 2, further including a charging device for applying an electrostatic charge potential to said photosensitive imaging substrate.

4. The imaging apparatus of claim 3, wherein said imaging device includes an image exposure device for projecting a light image onto the photosensitive imaging substrate to generate the electrostatic latent image.

5. The imaging apparatus of claim 1, wherein said imaging member includes a dielectric substrate.

6. The imaging apparatus of claim 1, wherein said imaging member includes a support surface and an electroded substructure capable of generating charged latent image areas.

7. The imaging apparatus of claim 1, wherein said marking material supply apparatus is adapted to deposit a layer of uncharged marking particles on the surface of said imaging member.

8. The imaging apparatus of claim 1, wherein said marking material supply apparatus is adapted to deposit a layer of electrically charged marking particles on the surface of said imaging member.

9. The imaging apparatus of claim 1, wherein said marking material supply apparatus is adapted to deposit a marking material layer having a thickness of approximately 2 to 15 microns on the surface of said imaging member.

10. The imaging apparatus of claim 9, wherein said marking material supply apparatus deposits a marking material layer on the surface of said imaging member having a thickness in a range between approximately 3 and 8 microns.

11. The imaging apparatus of claim 1, wherein said marking material supply apparatus is adapted to accommodate liquid developing material including marking particles immersed in a liquid carrier medium.

12. The imaging apparatus of claim 11, wherein said marking material supply apparatus is adapted to deposit a marking material layer having a solids percentage by weight of at least approximately 10%.

13. The imaging apparatus of claim 11, wherein said marking material supply apparatus is adapted to deposit a marking material layer having a solids percentage by weight in a range between approximately 15% and 35%.

14. The imaging apparatus of claim 1, wherein said marking material supply apparatus is adapted to supply a marking material layer having a substantially uniform density onto the surface of the imaging member.

15. The imaging apparatus of claim 1, wherein said marking material supply apparatus includes:

a housing adapted to accommodate a supply of marking particles therein; and a rotatably mounted applicator roll member for transporting marking particles from said housing to the surface of said imaging member.

16. The imaging apparatus of claim 15, wherein said marking material supply apparatus further includes an electrical biasing source coupled to said applicator roll member for applying an electrical bias thereto to generate electrical fields between said applicator roll member and said imaging member so as assist in forming the marking material layer on the surface of said imaging member.

17. The imaging apparatus of claim 1, wherein said marking material supply apparatus includes a fountain-type applicator assembly for transporting a flow of marking particles into contact with the surface of said imaging member.

18. The imaging apparatus of claim 17, wherein said marking material supply apparatus further includes a metering roll for applying a shear force to the marking material layer on the surface of said imaging member to control thickness thereof.

19. The imaging apparatus of claim 1, wherein said charging source is adapted to introduce free mobile ions in the vicinity of the imaging member having the electrostatic latent image and the marking material layer supported thereon, for creating an image-wise ion stream directed toward the marking material layer responsive to the electrostatic latent image on the imaging member.

20. The imaging apparatus of claim 19, wherein said charging source includes a DC biasing source coupled thereto for providing a biasing voltage to said charging source to generate ions having a single charge polarity in the vicinity of the imaging member having the electrostatic latent image and the marking material layer supported thereon.

21. The imaging apparatus of claim 19, wherein said charging source includes an AC biasing source coupled thereto for providing a biasing voltage to said charging source to generate ions having first and second charge polarities in the vicinity of the imaging member having the electrostatic latent image and the marking material layer supported thereon.

22. The imaging apparatus of claim 21, wherein said charging source further includes a DC biasing source coupled thereto for providing a DC offset to the biasing voltage.

23. The imaging apparatus of claim 1, wherein said charging source includes an electrical biasing source coupled to an electrode member for providing a biasing voltage intermediate the first and second charge voltages associated with the electrostatic latent image generated on the imaging member.

24. The imaging apparatus of claim 1, wherein said charging source includes an electrical biasing source coupled to an electrode member for providing a biasing voltage greater than the first and second charge voltages associated with the electrostatic latent image generated on the imaging member.

25. The imaging apparatus of claim 1, wherein said charging source includes a plurality of independent ion generating devices.

26. The imaging apparatus of claim 25, wherein said plurality of independent ion generating devices includes:

a first corona generating device for providing ions of a first charge polarity; and a second corona generating device for providing ions of a second charge polarity.

27. The imaging apparatus of claim 1, wherein said separator member is adapted to attract marking material layer image areas associated with the secondary latent image away from the imaging member so as to maintain marking material layer non-image areas associated with the secondary latent image on the surface of the imaging member.

28. The imaging apparatus of claim 27, further including a cleaning apparatus for removing said marking material layer non-image areas associated with the secondary latent image from the surface of said imaging member.

29. The imaging apparatus of claim 1, wherein said separator member is adapted to attract marking material layer non-image areas associated with the secondary latent image away from the imaging member so as to maintain marking material layer image areas associated with the secondary latent image on the surface of the imaging member.

30. The imaging apparatus of claim 29, further including a cleaning apparatus for removing said marking material layer non-image areas associated with the secondary latent image from the surface of said separator member.

31. The imaging apparatus of claim 1, wherein said separator member includes a peripheral surface for contacting the marking material layer to selectively attract portions thereof away from the imaging member.

32. The imaging apparatus of claim 31, wherein said separator member includes an electrical biasing source coupled to said peripheral surface for electrically attracting selectively charged portions of the marking material layer.

33. The imaging apparatus of claim 1, further including a transfer system for transferring the developed image to a copy substrate to produce an output copy thereof.

34. The imaging apparatus of claim 33, wherein said transfer system further includes a system for substantially simultaneously fixing the image to the copy substrate.

35. The imaging apparatus of claim 33, further including a fusing system for fusing the transferred image to the copy substrate.

36. An imaging process, comprising the steps of:

generating an electrostatic latent image on an imaging member having a surface capable of supporting toner particles, wherein the electrostatic latent image includes image areas defined by a first charge voltage and non-image areas defined by a second charge voltage distinguishable from the first charge voltage;

depositing toner particles on the surface of said imaging member to form a toner layer thereon adjacent the image and non-image areas of the electrostatic latent image;

selectively delivering charges to the toner layer in an image-wise manner responsive to the electrostatic latent image on said imaging member for forming a secondary latent image in the toner layer having image and non-image areas corresponding to the electrostatic latent image on said imaging member; and selectively separating portions of the toner layer from the imaging member in accordance with the secondary latent image in the toner layer for creating a developed image corresponding to the electrostatic latent image formed on the imaging member.

37. The imaging process of claim 36, wherein said electrostatic latent image generating step includes:

charging a photosensitive imaging substrate; and selectively dissipating the charge on the photosensitive imaging substrate in accordance with the image and non-image areas.

38. The imaging process of claim 36, wherein said electrostatic latent image generating step includes:

selectively depositing electrical charge on a dielectric imaging member in accordance with the image and non-image areas.

39. The imaging process of claim 36, wherein said toner layer depositing step includes depositing a layer of uncharged toner particles on the surface of the imaging member.

40. The imaging process of claim 36, wherein said toner layer depositing step includes depositing a layer of charged toner particles on the surface of the imaging member.

41. The imaging process of claim 36, wherein said toner layer depositing step includes forming a toner layer having a thickness of approximately 2 to 15 microns on the surface of said imaging member.

42. The imaging process of claim 41, wherein said toner layer depositing step includes forming a toner layer having a thickness in a range between approximately 3 and 8 microns on the surface of the imaging member.

43. The imaging process of claim 36, wherein said toner layer depositing step includes depositing liquid developing material including toner particles immersed in a liquid carrier medium.

44. The imaging process of claim 43, wherein said toner layer depositing step is adapted to deposit a toner layer having a toner solids percentage by weight of at least approximately 10%.

45. The imaging process of claim 44, wherein said toner layer depositing step is adapted to deposit a toner layer having a toner solids percentage by weight in a range between approximately 15% and 35%.

46. The imaging process of claim 36, wherein said toner layer depositing step is adapted to deposit a toner layer having a substantially uniform density onto the surface of the imaging member.

47. The imaging process of claim 36, wherein said step of selectively delivering charges to the toner layer is adapted to introduce free mobile ions in the vicinity of the imaging member having the electrostatic latent image and the toner layer supported thereon, for creating an image-wise ion stream directed toward the toner layer responsive to the electrostatic latent image on the imaging member.

48. The imaging process of claim 47, wherein said step of selectively delivering charges to the toner layer is adapted to generate ions having a single charge polarity in the vicinity of the imaging member having the electrostatic latent image and the toner layer supported thereon.

49. The imaging process of claim 47, wherein said step of selectively delivering charges to the toner layer is adapted to generate ions having first and second charge polarities in the vicinity of the imaging member having the electrostatic latent image and the toner layer supported thereon.

50. The imaging process of claim 36, wherein said step of selectively delivering charges to the toner layer further includes a step for providing a biasing voltage intermediate the first and second charge voltages associated with the electrostatic latent image generated on the imaging member.

51. The imaging process of claim 36, wherein said step of selectively delivering charges to the toner layer further includes a step for providing a biasing voltage greater than the first and second charge voltages associated with the electrostatic latent image generated on the imaging member.

52. The imaging process of claim 36, wherein said step of selectively delivering charges to the toner layer includes a first step for generating ions having a first charge polarity in the vicinity of the imaging member having the electrostatic latent image and the toner layer supported thereon; and a second step for generating ions having a second charge polarity in the vicinity of the imaging member having the electrostatic latent image and the toner layer supported thereon.

53. The imaging process of claim 36, wherein said step of selectively separating portions of the toner layer from the imaging member includes the step of attracting toner layer image areas associated with the secondary latent image away from the imaging member so as to maintain toner layer non-image areas associated with the secondary latent image on the surface of the imaging member.

54. The imaging process of claim 36, wherein said step of selectively separating portions of the toner layer from the imaging member includes the step of attracting toner layer non-image areas associated with the secondary latent image away from the imaging member so as to maintain toner layer image areas associated with the secondary latent image on the surface of the imaging member.

55. The imaging process of claim 36, wherein said step of selectively separating portions of the toner layer from the imaging member includes providing a member having a peripheral surface for contacting the toner layer to selectively attract portions thereof away from the imaging member.

56. The imaging process of claim 55, wherein said step of selectively separating portions of the toner layer from the imaging member further includes providing an electrical bias to the member having a peripheral surface for contacting the toner layer to electrically attract selectively charged portions of the toner layer away from the imaging member.

57. The imaging process of claim 36, further including a transfer step for transferring the developed image to a copy substrate to produce an output copy thereof.

58. The imaging process of claim 57, wherein said transfer step further includes the step of substantially simultaneously fixing the image to the copy substrate.

59. The imaging process of claim 57, further including a fusing step for fusing the transferred image to the copy substrate.

60. The imaging process of claim 57, further including a cleaning step for removing said toner layer non-image areas associated with the secondary latent image from the surface of said imaging member.

61. The imaging process of claim 57, further including a cleaning step for removing said toner layer non-image areas associated with the secondary latent image from a surface of a separator member.

62. The imaging process of claim 36, wherein said step of generating an electrostatic latent image on an imaging member precedes said step of depositing toner particles on the surface of said imaging member.

63. The image development process of claim 36, wherein said step of generating an electrostatic latent image on an imaging member occurs subsequent to said step of depositing toner particles on the surface of said imaging member.

64. An image development apparatus for developing an electrostatic latent image formed on an imaging member, comprising:

means for depositing a layer of marking particles on the imaging member;

means for creating an electrical discharge in a vicinity of the layer of marking particles on the imaging member to selectively charge the layer of marking particles in response to the electrostatic latent image on the imaging member so as to create a second electrostatic latent image in the layer of marking particles; and means for selectively separating portions of the layer of marking particles in accordance with the second latent image for creating a developed image corresponding to the electrostatic latent image formed on the imaging member.

65. The image development apparatus of claim 64, wherein the layer of marking particles on the imaging member includes uncharged toner particles.

66. The image development apparatus of claim 64, wherein the layer of marking particles on the imaging member includes electrically charged toner particles.

67. The image development apparatus of claim 64, wherein the layer of marking particles on the imaging member has a thickness of approximately 2 to 15 microns.

68. The image development apparatus of claim 67, wherein the layer of marking particles on the imaging member has a thickness in a range between approximately 3 and 8 microns.

69. The image development apparatus of claim 64, wherein the layer of marking particles on the imaging member comprises liquid developing material including toner particles immersed in a liquid carrier medium.

70. The image development apparatus of claim 69, wherein the liquid developing material includes a toner solids percentage by weight of at least approximately 10%.

71. The image development apparatus of claim 70, wherein the liquid developing material includes a toner solids percentage by weight in a range between approximately 15% and 35%.

72. The image development apparatus of claim 64, wherein the layer of marking particles on the imaging member has a substantially uniform thickness.

73. The image development apparatus of claim 64, wherein said means for creating an electrical discharge provides free mobile ions proximate to the imaging member having the electrostatic-latent image and the layer of marking particles supported thereon for creating an image-wise ion stream directed toward the electrostatic latent image on the imaging member.

74. The image development apparatus of claim 73, wherein said means for creating an electrical discharge includes a DC biasing source for creating an image-wise ion stream having a single charge polarity.

75. The image development apparatus of claim 73, wherein said means for creating an electrical discharge includes an AC biasing source for creating an image-wise ion stream having first and second charge polarities.

76. The image development apparatus of claim 75, further including a DC biasing source coupled to the AC biasing source for providing a DC offset to the AC biasing output.

77. The image development apparatus of claim 64, wherein said means for creating an electrical discharge includes a plurality of independently biased corona generating devices.

78. The image development apparatus of claim 77, wherein said plurality of independently biased corona generating devices includes:

a first corona generating device for providing ions of a first charge polarity; and a second corona generating device for providing ions of a second charge polarity.

79. The image development apparatus of claim 64, wherein said selective separating means includes a peripheral surface for contacting the layer of marking particles to selectively attract portions thereof away from the imaging member.

80. The image development apparatus of claim 79, wherein said selective separating means removes image areas of the second latent image in the layer of marking particles so as to maintain non-image areas of the second latent image in the layer of marking particles on the surface of the imaging member.

81. The image development apparatus of claim 64, wherein said selective separating means removes non-image areas of the second latent image in the layer of marking particles so as to maintain image areas of the second latent image in the layer of marking particles on the surface of the imaging member.

82. An image development process for developing an electrostatic latent image formed on an imaging member, comprising the steps of:

depositing a layer of marking particles on the imaging member;

selectively charging the layer of marking particles in response to the electrostatic latent image for creating a second electrostatic latent image in the layer of marking particles corresponding to the electrostatic latent image on the imaging member; and selectively separating portions of the layer of marking particles in accordance with the second latent image for creating a developed image.

83. The image development process of claim 82, wherein the layer of marking particles on the imaging member includes uncharged toner particles.

84. The image development process of claim 82, wherein the layer of marking particles on the imaging member includes electrically charged toner particles.

85. The image development process of claim 82, wherein said step of depositing a layer of marking particles on the imaging member includes the step of depositing a substantially uniform thickness of marking particles onto the imaging member.

86. The image development process of claim 82, wherein said selective charging step includes directing an image-wise ion stream to the electrostatic latent image on the imaging member having the layer of marking particles supported thereon such that ions are captured in an image-wise manner by the layer of marking particles on the imaging member to create the second latent image therein.

87. The image development process of claim 86, wherein said selective charging step includes creating an image-wise ion stream having a single charge polarity.

88. The image development process of claim 86, wherein said selective charging step creating an image-wise ion stream having first and second charge polarities.

89. The image development process of claim 82, wherein said selective separating step includes the step of removing image areas of the second latent image form the layer of marking particles so as to maintain non-image areas of the second latent image in the layer of marking particles on the surface of the imaging member.

90. The image development process of claim 82, wherein said selective separating step includes the step of removing non-image areas of the second latent image in the layer of marking particles so as to maintain image areas of the second latent image in the layer of marking particles on the surface of the imaging member.

91. An image development apparatus, comprising:

means for generating a first electrostatic latent image on an imaging member, wherein the first electrostatic latent image includes image and non-image areas having distinguishable charge potentials; and means for generating a second electrostatic latent image in a toner layer situated adjacent the first electrostatic latent image on the imaging member, wherein the second electrostatic latent image includes image and non-image areas having distinguishable charge potentials of a polarity opposite to the charge potentials of the charged image and non-image areas in the first electrostatic latent image.

92. A process for image development, comprising the steps of:

generating a first electrostatic latent image on an imaging member, wherein the first electrostatic latent image includes image and non-image areas having distinguishable charge potentials; and generating a second electrostatic latent on a toner layer situated adjacent the first electrostatic latent image on the imaging member, wherein the second electrostatic latent image includes image and non-image areas having distinguishable charge potentials of a polarity opposite to the charge potentials of the charged image and non-image areas in the first electrostatic latent image.

93. An image development apparatus, comprising:

an imaging member including an imaging surface having a layer of marking material thereon; and means for creating an electrostatic latent image in the layer of marking material.

94. An image development process for developing an image on an imaging member, comprising the steps of:

providing a layer of marking material on a surface of the imaging member; and generating an electrostatic latent image in the layer of marking material.

* * * * *